US009095742B2

(12) United States Patent
Henniger et al.

(10) Patent No.: US 9,095,742 B2
(45) Date of Patent: Aug. 4, 2015

(54) MODULAR SQUAT STAND SYSTEM

(75) Inventors: William Henniger, Columbus, OH (US); Ian Maclean, Columbus, OH (US)

(73) Assignee: COULTER VENTURES, LLC, Columbus, OH (US)

( * ) Notice: Subject to any disclaimer, the term of this patent is extended or adjusted under 35 U.S.C. 154(b) by 50 days.

(21) Appl. No.: 13/230,000

(22) Filed: Sep. 12, 2011

(65) Prior Publication Data

US 2013/0065738 A1 Mar. 14, 2013

(51) Int. Cl.

| | |
|---|---|
| ***A63B 21/078*** | (2006.01) |
| ***A63B 21/06*** | (2006.01) |
| ***A63B 21/072*** | (2006.01) |
| ***A63B 23/04*** | (2006.01) |

(52) U.S. Cl.

CPC ..... *A63B 21/0724* (2013.01); *A63B 21/0728* (2013.01); *A63B 23/0405* (2013.01); *A63B 2023/0411* (2013.01); *A63B 2225/093* (2013.01)

(58) Field of Classification Search

CPC ..... A63B 21/0724; A63B 21/0728; A63B 2023/0411

USPC ..... 482/87, 92–96, 104, 105–108, 85, 83, 482/86, 89–90, 97, 98, 109, 133, 135, 139; 108/15, 16, 55.5, 56.3; 211/189–192, 211/204, 206; 248/125.1

See application file for complete search history.

(56) References Cited

U.S. PATENT DOCUMENTS

| | | | | |
|---|---|---|---|---|
| 6,065,612 | A * | 5/2000 | Rinderer | 211/26 |
| 6,149,556 | A * | 11/2000 | Jordan | 482/104 |
| 6,685,601 | B1 * | 2/2004 | Knapp | 482/104 |
| D590,032 | S * | 4/2009 | Webber et al. | D21/673 |
| 7,806,437 | B2 * | 10/2010 | Bowers | 280/756 |
| 2006/0025285 | A1 * | 2/2006 | Giusti | 482/83 |
| 2006/0191234 | A1 * | 8/2006 | Gadd et al. | 52/714 |
| 2007/0155596 | A1 * | 7/2007 | Rogers et al. | 482/97 |
| 2010/0190612 | A1 * | 7/2010 | Cook | 482/38 |

OTHER PUBLICATIONS www.fitstream.com/blog/2010/01/power-station-squat-rack-from-australian-kettlebel Jan. 14, 2010.*

(Continued)

*Primary Examiner* — Loan H Thanh
*Assistant Examiner* — Nyca T Nguyen
(74) *Attorney, Agent, or Firm* — Christopher Paul Mitchell

(57) ABSTRACT

The modular squat stand system may include a plurality of upright members, each including a plurality of upright member holes. The modular squat stand system may further include a base including a plurality of upright member sockets, each the plurality of upright member sockets including first, second, and third sides. The first and third sides may be connected by the second side. The first and third sides may be parallel relative to each other, and perpendicular relative to said second side. The first and third sides may each include a plurality of upright member socket holes. At least one of the first and third sides may include an integrated gusset. The plurality of upright member sockets may be configured to removably accept the plurality of upright members by receiving fastening members through the plurality of upright member socket holes and the plurality of upright member holes.

6 Claims, 6 Drawing Sheets

(56) References Cited

OTHER PUBLICATIONS

Maverick AthleticCo Facebook Account, "Playing around with some new toys . . . We love prototypes!!!", Jul. 15, 2011, Wall Photos, http://www.facebook.com/photo.php?fbid=210239892355464&set=a.108390872540367.4386.100001083638738&type=3&theater (accessed on Feb. 11, 2012).

Sorinex Exercise Equipment Website, "ACME 2010 (Adjustable Squat Stand)", http://store.sorinex.com/ACME_2010_Adjustable_Squat_Stand_p/acme-2010.htm (accessed on Feb. 22, 2012).

* cited by examiner

MODULAR SQUAT STAND SYSTEM

BACKGROUND

1. Field

Embodiments of the present invention relate generally to exercise equipment. More particularly, embodiments of the present invention relate to a modular squat stand system.

2. Description of the Related Art

Squat stands are known in the art. Existing squat stands may be used for a variety of exercises. However, different squat stands may be required for different exercises. For example, squats may require one type of squat stand while pull-ups may require a different type of squat stand. Not only may this be inconvenient from the standpoint of a user, it also may be undesirable from a manufacturing standpoint in that, for example, each particular type of squat stand may have specific parts custom to that particular design.

In light of the foregoing and other shortcomings in the art, it is desirable to provide an improved squat stand system.

BRIEF SUMMARY

According to an aspect of the invention, a modular squat stand system may be provided. The modular squat stand system may include a base including at least one upright member socket, the at least one upright member socket including first, second, and third sides. The first and third sides may be connected by the second side. The first and third sides may be parallel relative to each other, and perpendicular relative to the second side. The first and third sides may each include at least one upright member socket hole. The at least one upright member socket may be configured to removably accept an upright member including at least one upright member hole by receiving a fastening member through the at least one upright member socket holes and the at least one upright member hole.

According to another aspect of the invention, a modular squat stand system may be provided. The modular squat stand system may include a plurality of upright members, each including a plurality of upright member holes. The modular squat stand system may further include a base including a plurality of upright member sockets, each the plurality of upright member sockets including first, second, and third sides. The first and third sides may be connected by the second side. The first and third sides may be parallel relative to each other, and perpendicular relative to the second side. The first and third sides may each include a plurality of upright member socket holes. At least one of the first and third sides may include an integrated gusset. The plurality of upright member sockets may be configured to removably accept the plurality of upright members by receiving fastening members through the plurality of upright member socket holes and the plurality of upright member holes.

According to another aspect of the invention, a modular squat stand system may be provided. The modular squat stand system may include two upright members, each of said two upright members including a plurality of upright member holes. The modular squat stand system may further include a base including two upright member sockets, each of said two upright member sockets including first, second, and third sides. The first and third sides may be connected by the second side. The first and third sides may be parallel relative to each other, and perpendicular relative to the second side. The first and third sides each may include a plurality of upright member socket holes. At least one of the first and third sides may include an integrated gusset. The two upright member sockets may be configured to removably accept the two upright members by receiving fastening members through the plurality of upright member socket holes and the plurality of upright member holes.

The foregoing and other aspects will become apparent from the following detailed description when considered in conjunction with the accompanying drawing figures.

DETAILED DESCRIPTION

Figure 1:
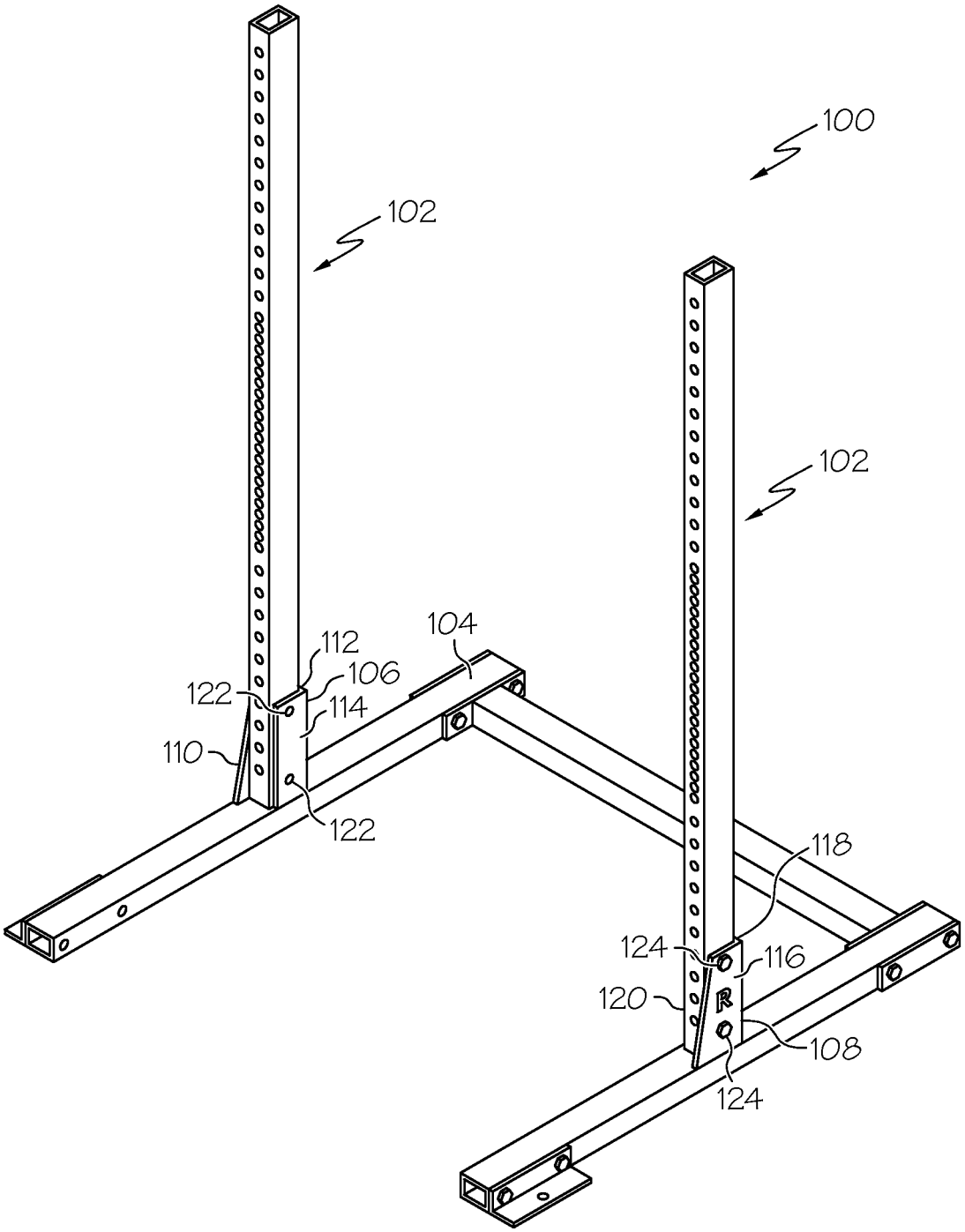
FIG. 1 is a schematic representation of a modular squat stand system according to an exemplary embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

As used in the description of this application, the terms "a", "an" and "the" may refer to one or more than one of an element (e.g., item or act). Similarly, a particular quantity of an element may be described or shown while the actual quantity of the element may differ. The terms "and" and "or" may be used in the conjunctive or disjunctive sense and will generally be understood to be equivalent to "and/or". Elements from an embodiment may be combined with elements of another. No element used in the description of this application should be construed as critical or essential to the invention unless explicitly described as such. Further, when an element is described as "connected," "coupled," or otherwise linked to another element, it may be directly linked to the other element, or intervening elements may be present.

An embodiment of the present invention may provide a modular squat stand system. Two upright members (or "uprights") may be easily placed within and removed from two upright member sockets. Accordingly, upright members of different sizes or configurations may be placed within the upright member sockets. For example, a first set of upright members may be easily removed, and either taller or shorter upright members may be placed within the upright member sockets. Thus, upright members chosen from among upright members of different heights may be selected and used by a user for a particular desired exercise. Similarly, four plate holder and foot assemblies may be removably attached to a base of the modular squat stand system for desired yoke exercises. In at least these two aspects, the squat stand system may be modular.

FIG. 1 is a schematic representation of a modular squat stand system 100 according to an exemplary embodiment of the present invention. The modular squat stand system 100 may include two upright members 102 and a base 104. Although the modular squat stand system 100 is shown including two upright members 102 and a base 104, the invention is not so limited. For example, in an alternative embodiment, a modular squat stand system may include a single upright member with a single base (e.g., a two-part "H-base" squat stand).

Figure 2:
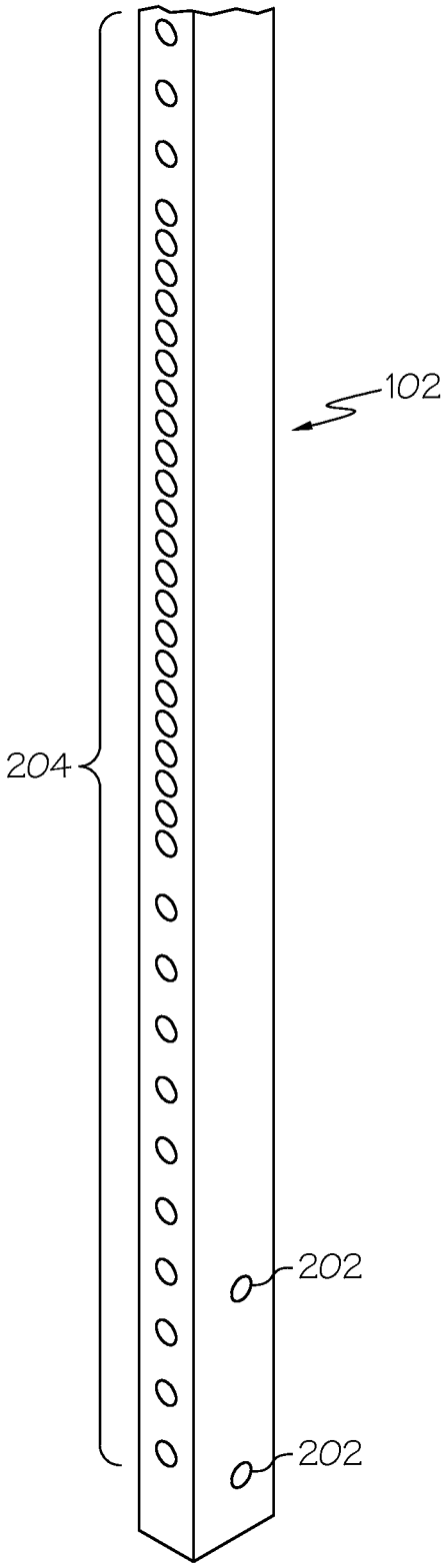
FIG. 2 is a schematic representation of a portion of an upright member according to an exemplary embodiment of the present invention.
Figure 3:
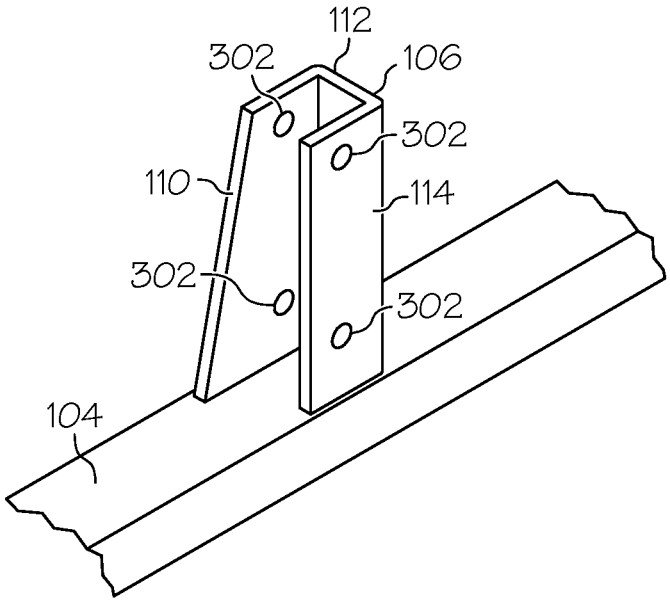
FIGS. 3-5 are schematic representations of a first upright member socket of the modular squat stand system of FIG. 1.
Figure 4:
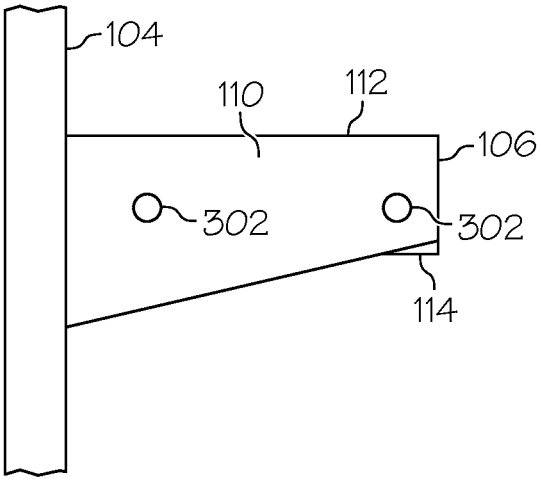

Each of the two upright members 102 may include two upright member holes 202 (FIG. 2). In addition, each of the upright members 102 may include additional holes 204 for connection to additional elements (additional elements not shown in this embodiment). Each of the two upright members 102 may be 72 inches tall, 2 inches wide, and 3 inches deep. Although each of the two upright members 102 are shown including two upright member holes 202 and being, for example, 72 inches tall, the invention is not so limited. For example, in alternative embodiments, an upright member 102 may include three upright member holes, or may be, for example, 70 inches, 92 inches or 110 inches tall. Further, upright members chosen from among upright members of different heights may be selected and used by a user for a particular desired exercise. Thus, the squat stand system may be modular.

The base 104 may include two upright member sockets 106, 108. It would be appreciated by those skilled in the art that the first upright member socket 106 is a "mirror image" of the second upright member socket 108. The two upright member sockets 106, 108 may be welded to the base 104. Specifically, a lower edge of the upright member sockets 106, 108 may be welded to a top surface of the base 104. Portions of the base 104 (e.g., four end portions) may each include two base holes that may be used to secure the base to a floor. Although the base 104 is shown including two upright member sockets 106, 108 that are mirror images of each other and that are welded to the base 104, and portions that each may include base holes, the invention is not so limited. For example, in alternative embodiments, the base 104 may include one upright member socket, or may include a plurality of upright member sockets that are identical and not mirror images to each other, and each upright member socket may be bolted to a base.

Referring now to FIGS. 1 and 3-5, the first upright member socket 106 may include first, second, and third sides 110, 112, 114. The first 110 and third 114 sides may be connected by the second side 112. The first 110 and third 114 sides may be parallel relative to each other, and perpendicular relative to said second side 112. Although the first upright member socket 106 is shown including first, second, and third sides 110, 112, 114, the invention is not so limited. For example, in an alternative embodiment, an upright member socket may include only first and second sides that may be parallel relative to each other. The first 110 and third 114 sides may each include two upright member support holes 302. One of the two upright support holes 302 may be positioned above the other. Although each of the first 110 and third 114 sides are shown including two upright member support holes 302, one being positioned above the other, the invention is not so limited. For example, in an alternative embodiment, each of first and third sides may include three upright member holes.

Figure 5:
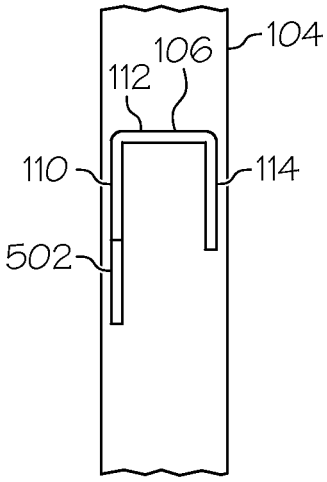
Figure 6:
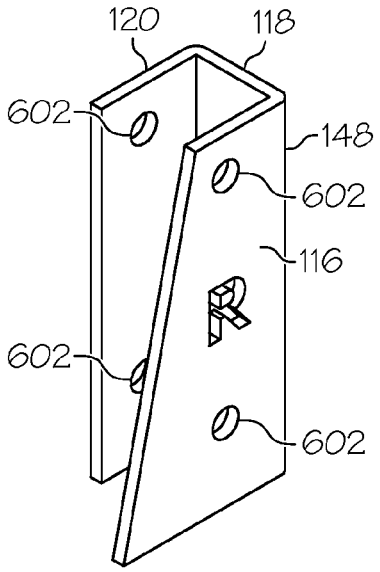
FIGS. 6-9 are schematic representations of a second upright member socket of the modular squat stand system of FIG. 1.

The first side 110 may include a gusset 502 (FIG. 5). The gusset 502 may be integral to the first side 110 as shown in FIGS. 1 and 3-5. The gusset may be triangular. For example, the gusset may be in the shape of a right triangle. A lower edge of the gusset 502 (which may be an extension of the first side 110) may be welded to the top surface of the base 104 (along with lower edges of the first, second, and third sides). The gusset 502 may increase the stability of the upright member socket 106. Although the gusset 502 is shown as triangular and part of the first side 110, the invention is not so limited. For example, in alternative embodiments, a gusset may be rectangular and may additionally or alternatively be part of a third side, or may be omitted.

Referring now to FIGS. 1 and 6-9, the second upright member socket 108 may include first, second, and third sides 116, 118, 120. The first 116 and third 120 sides may be connected by the second side 118. The first 116 and third 120 sides may be parallel relative to each other, and perpendicular relative to said second side 118. Although the second upright member socket 108 is shown including first, second, and third sides 116, 118, 120, the invention is not so limited. For example, in an alternative embodiment, an upright member socket may include only first and second sides that may be parallel relative to each other. The first 116 and third 120 sides may each include two upright member support holes 602. One of the two upright support holes 602 may be positioned above the other. Although each of the first 116 and third 120 sides are shown including two upright member support holes 602, one being positioned above the other, the invention is not so limited. For example, in an alternative embodiment, each of first and third sides may include three upright member holes.

Figure 8:
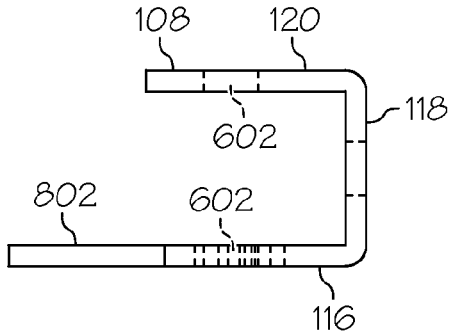
Figure 7:
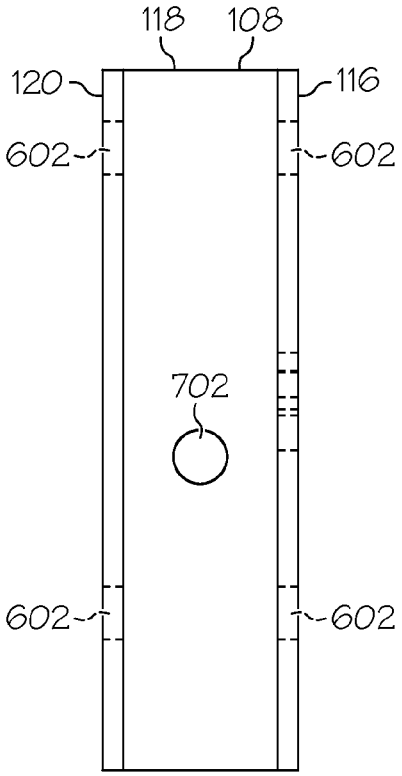
Figure 9:
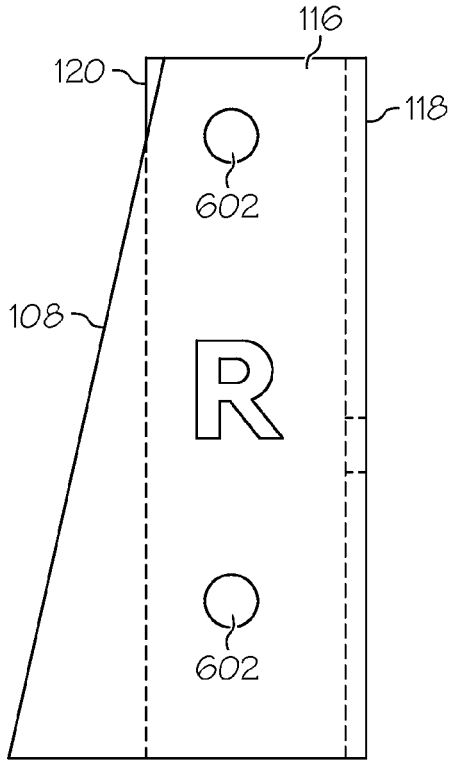

The first side 116 may include a gusset 802 (FIG. 8). The gusset 802 may be integral to the first side 116 as shown in FIGS. 1 and 6-9. The gusset may be triangular. For example, the gusset may be in the shape of a right triangle. A lower edge of the gusset 802 (which may be an extension of the first side 116) may be welded to the top surface of the base 104 (along with lower edges of the first, second, and third sides). The gusset 802 may increase the stability of the upright member socket 108. Although the gusset 802 is shown as triangular and part of the first side 116, the invention is not so limited. For example, in alternative embodiments, a gusset may be rectangular and may additionally or alternatively be part of a third side, or may be omitted.

The two upright member sockets 106, 108 may be 9 inches tall. The first sides 110, 116 may be 3 inches wide at the top and 4 inches wide at the bottom, inclusive of the integrated gussets 502, 802. The second sides 112, 118 may be 2 inches wide. The third sides 114, 120 may be 3 inches wide. Although the two upright member sockets 106, 108 are described as being certain dimensions, the invention is not so limited. For example, in an alternative embodiment, the two upright member sockets 106, 108 may be different dimensions.

The two upright member sockets 106, 108 may be configured to removably accept the two upright members 102. Referring to FIGS. 1-5, an upright member 102 may be placed within the upright member socket 106. That is, a bottom of the upright member 102 may be placed within the first, second, and third sides 110, 112, 114 of the upright member socket 106 such that the two upright member support holes 302 of the first 110 and third 114 sides and the upright member holes 202 of the upright member 102 align. Fastening members may secure the two upright members 102 to the two upright member sockets 106, 108. The fastening members may each include a threaded bolt 124 and a nut 122. Threaded bolts 124 may be inserted through the two upright member support holes 302 of the first side 110, then the two upright member holes 202, and then the two upright member support holes 302 of the third side 114. Nuts 122 may then be attached to the threaded bolts 124. Although the upright member socket 106 is shown accepting the upright member 102 using threaded bolts and nuts, the invention is not so limited. For example, in an alternative embodiment, an upright member socket may accept an upright member using a latch assembly.

Referring to FIGS. 1, 2, and 6-9, an upright member 102 may be placed within the upright member socket 108. That is, a bottom of the upright member 102 may be placed within the first, second, and third sides 116, 118, 120 of the upright member socket 108 such that the two upright member support holes 602 of the first 116 and third 120 sides and the upright member holes 202 of the upright member 102 align. As noted above, fastening members may secure the two upright members 102 to the two upright member sockets 106, 108. The fastening members may each include a threaded bolt 124 and a nut 122. Threaded bolts 124 may be inserted through the two upright member support holes 602 of the first side 116, then the two upright member holes 202, and then the two upright member support holes 602 of the third side 120. Nuts 122 may then be attached to the threaded bolts 124. Although the upright member socket 108 is shown accepting the upright member 102 using threaded bolts and nuts, the invention is not so limited. For example, in an alternative embodiment, an upright member socket may accept an upright member using a latch assembly.

It would be appreciated by those skilled in the art that the two upright members 102 may be easily placed within and removed from the upright member sockets 106, 108. Accordingly, the upright members 102 may be removed and upright members of a different size or configuration may be placed within the upright member sockets 106. For example, the 72 inch tall upright members 102 may be removed and either 92 inch or 110 inch tall uprights may be placed within the upright member sockets. Thus, upright members chosen from among upright members of different heights may be selected and used by a user for a particular desired exercise. In other words, the squat stand system may be modular.

All or part of the modular squat stand system may be formed of metal. For example, the upright member sockets 106, 108 may be formed of ⅜ inch flat steel that may be bent into a desired shape. Although, for example, the upright member sockets are described as being formed of bent flat steel, the invention is not so limited. For example, in an alternative embodiment, all or part of the modular squat stand system may be formed of alternative materials.

Figure 10:
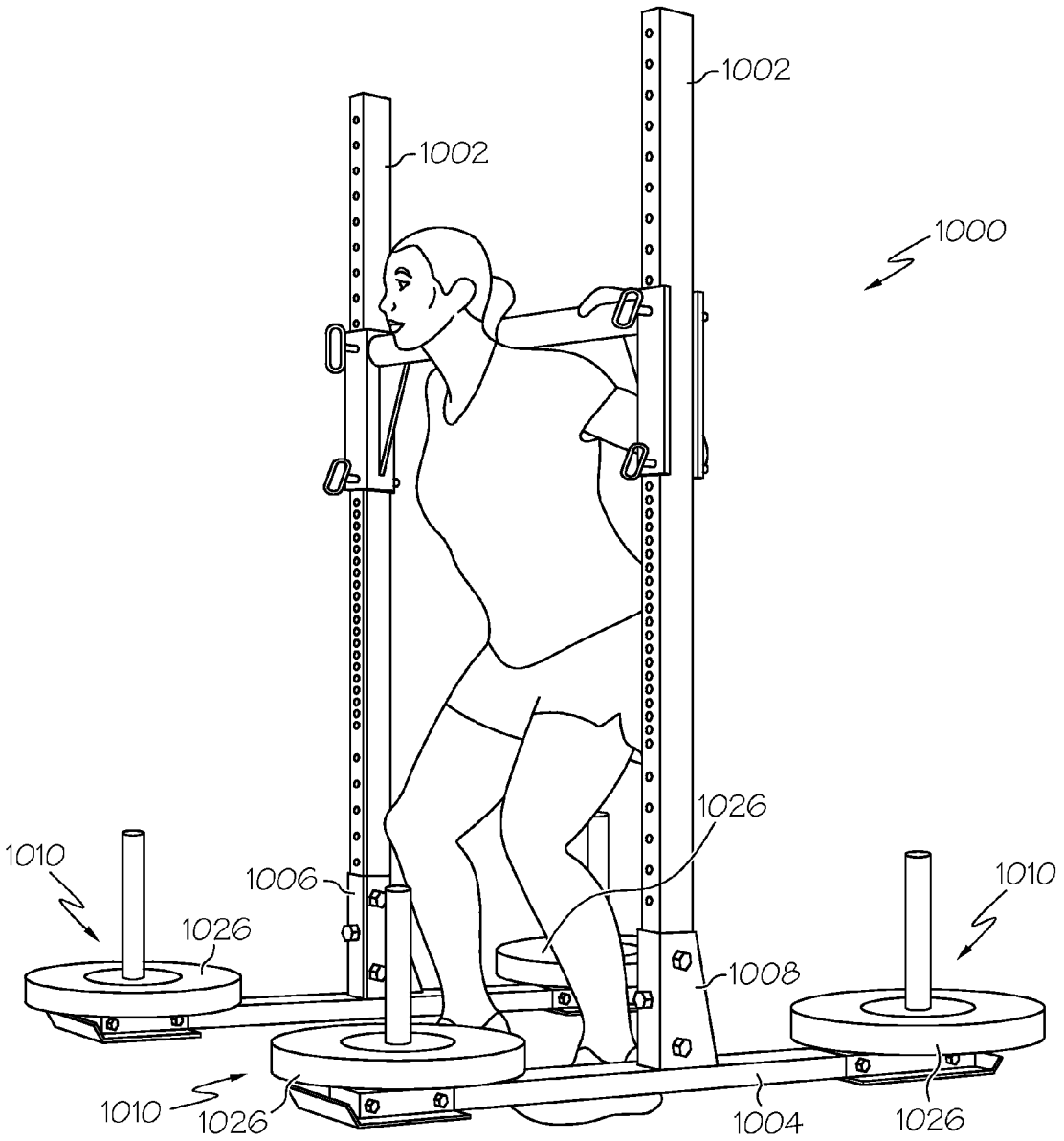
FIGS. 10-11 are schematic representations of a modular squat stand system according to another exemplary embodiment of the present invention.
Figure 11:
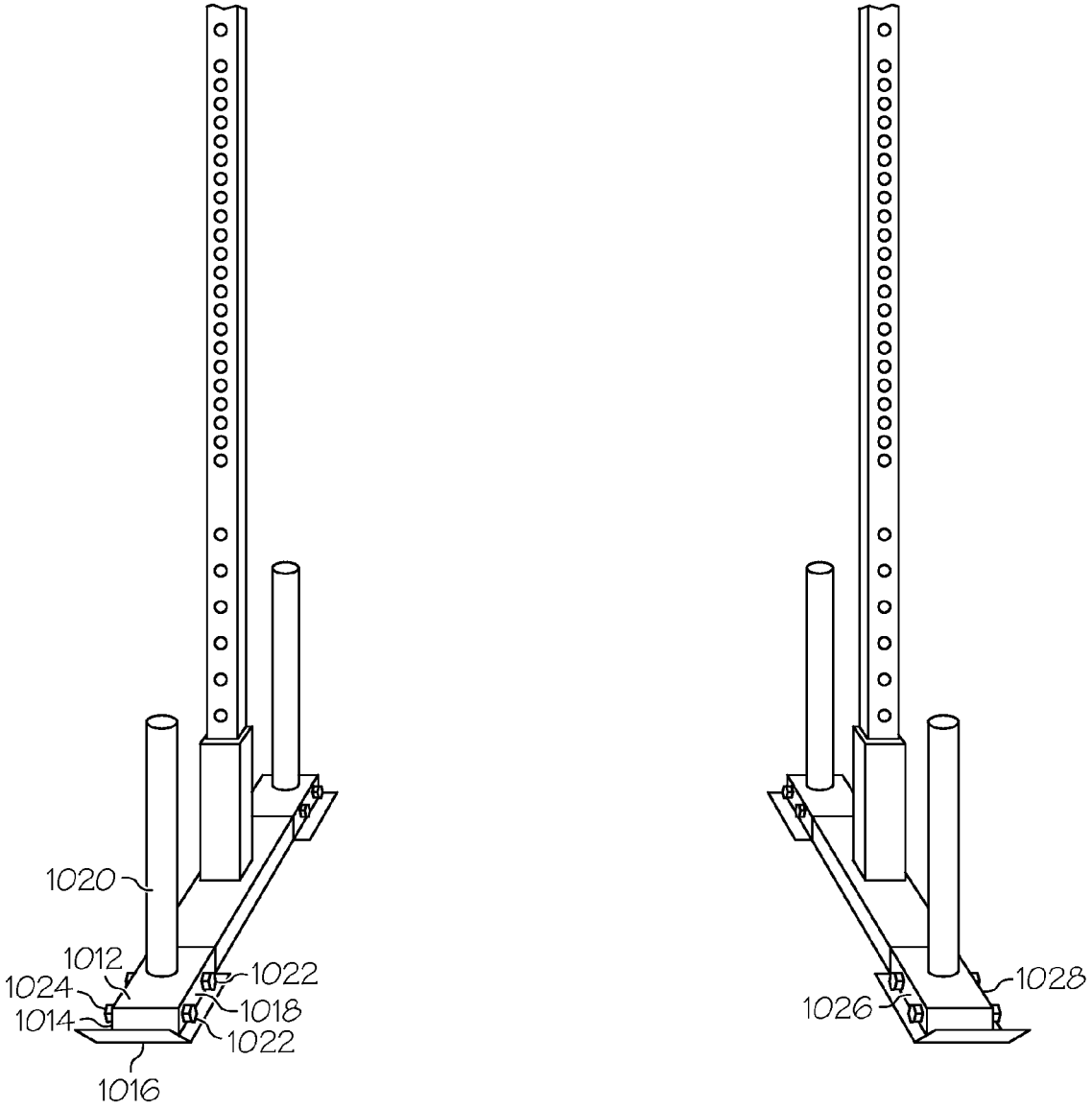

FIGS. 10-11 are schematic representations of a modular squat stand system 1000 according to another exemplary embodiment of the present invention. The modular squat stand system 1000 may include two upright members 1002 and a base 1004. Aspects of the modular squat stand system 1000 including the two upright members 1002, and the base 1004 may be similar to the modular squat stand system 100 of FIGS. 1-9, including the alternative embodiments discussed above. Accordingly, further description of such aspects is omitted in the interest of brevity.

In addition to two upright member sockets 1006, 1008, the base 1004 may include four plate and foot assemblies 1010. Each of the four plate and foot assemblies 1010 may include a top surface 1012, a first side 1014, a bottom skid plate 1016, and a second side 1018, which together may form a rectangular tube. The top surface 1012 of each plate and foot assembly 1010 may include a plate holder 1020. Each plate holder 1020 may be cylindrical in shape. Plates 1026 may be placed on the plate holders 1020. Although the plate and foot assemblies 1010 are shown including a top surface 1012, a first side 1014, a bottom skid plate 1016, a second side 1018, and a cylindrical plate holder 1020, the invention is not so limited. For example, in alternative embodiments, elements (e.g., the second side 1018) may be omitted or altered (e.g., each plate holder may be of a different shape).

The first and second sides 1014, 1018 may each include two plate and foot assembly holes. Portions of the base 1004 (e.g., four end portions) may each include two base holes. Although each of the first and second sides are described as including two plate and foot assembly holes, and each of the portions of the base 1004 are described as including two base holes, the invention is not so limited. For example, in an alternative embodiment, each of a top surface and a bottom skid plate may include more than or less than two plate and foot assembly holes, and each of the portions of the base 1004 may include corresponding base holes.

The four plate and foot assemblies 1010 may be removably attached to the base. Each of the four plate and foot assemblies 1010 may be placed over each of the portions of the base 1004 such that the two plate and foot assembly holes of each of the first and second sides 1014, 1018 align with the two base holes. Fastening members may secure the four plate and foot assemblies 1010 to four portions of the base 1004. The fastening members may each include a threaded bolt 1026 and a nut 1028. Threaded bolts 1026 may be inserted through the two plate and foot assembly holes of the first side 1014, then the two base holes, and then the two plate and foot assembly holes of the second side 1018. Nuts 1028 may then be attached to the threaded bolts 1026. Although the portions of the base are shown accepting the plate and foot assemblies 1010 using threaded bolts and nuts, the invention is not so limited. For example, in an alternative embodiment, a portion of a base may accept a plate and foot assembly using a latch assembly. As noted above, elements from one embodiment may be combined with elements from another. Thus, elements of the modular squat stand system 100 may be combined with elements of the modular squat stand system 1000. It would be appreciated by those skilled in the art that such a combination would allow for even more selection of elements by a user for a particular desired exercise.

Embodiments of the present invention may provide multiple advantages. For example, because upright members of different sizes and configurations may be easily removed and placed within the upright member sockets, and because plate and foot assemblies may be easily added, the squat stand system may be modular. Thus, one modular squat stand system may be used for a variety of different exercises. Because upright members of different sizes and configurations may be easily removed and placed within the upright member sockets, manufacture of the uprights may be simpler and more cost efficient than in systems that require uprights manufactured for particular bases. As yet another exemplary advantage, the upright member socket according to an embodiment of the present invention may provide for improved strength between an upright and a modular squat stand base.

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A modular squat stand system, comprising:

two upright members, each of said two upright members including a plurality of upright member holes; and a base including two upright member sockets, each of said two upright member sockets including first, second, and third sides, wherein said first and third sides are connected by said second side;

wherein said first and third sides are parallel relative to each other, and perpendicular relative to said second side;

wherein said first and third sides each include a plurality of upright member socket holes;

wherein at least one of said first and third sides includes an integrated gusset;

wherein said two upright member sockets are configured to removably accept said two upright members by receiving fastening members through said plurality of upright member socket holes and said plurality of upright member holes;

wherein the base further includes four plate and foot assemblies, wherein each plate and foot assembly includes:

a top surface;

a first side;

a bottom skid plate; and a second side, wherein the top surface, first side, bottom skid plate, and second side together form a rectangular tube, and wherein said top surface includes a cylindrical plate holder.

2. The squat stand system of claim 1, wherein said first and third sides of the two upright member sockets each include two upright member socket holes.

3. The squat stand system of claim 2, wherein one of said two upright member socket holes is positioned above the other.

4. The squat stand system of claim 1, wherein the base further includes:

a first rectangular tube base member having four sides including a top surface; and a second rectangular tube base member having four sides including a top surface, and wherein a lower edge of a first of the two upright member sockets is connected to the top surface of the first rectangular tube base member, and wherein a lower edge of a second of the two upright member sockets is connected to the top surface of the second rectangular tube base member, and wherein the lower edge of the first of the two upright member sockets and the lower edge of the second of the two upright member sockets, including said integrated gusset, are welded to said top surface of the first rectangular tube base member and said top surface of the second rectangular tube base member, respectively.

5. The squat stand system of claim 4, wherein the gusset is in the shape of a right triangle.

6. The squat stand system of claim 1, wherein at least one of said fastening members comprises a threaded bolt and a nut.

* * * * *